US009022875B2

(12) United States Patent
Wong

(10) Patent No.: US 9,022,875 B2
(45) Date of Patent: May 5, 2015

(54) GOLF PUTTER WITH CLEAR ALIGNMENT AID INSERT

(76) Inventor: Dennis Wong, Richmond (CA)

( * ) Notice: Subject to any disclaimer, the term of this patent is extended or adjusted under 35 U.S.C. 154(b) by 0 days.

(21) Appl. No.: 14/008,493

(22) PCT Filed: Mar. 26, 2012

(86) PCT No.: PCT/CA2012/000312

§ 371 (c)(1),
(2), (4) Date: Sep. 27, 2013

(87) PCT Pub. No.: WO2012/129672

PCT Pub. Date: Oct. 4, 2012

(65) Prior Publication Data

US 2014/0018180 A1 Jan. 16, 2014

Related U.S. Application Data

(60) Provisional application No. 61/470,272, filed on Mar. 31, 2011.

(51) Int. Cl.

| | |
|---|---|
| ***A63B 69/36*** | (2006.01) |
| ***A63B 53/04*** | (2006.01) |
| ***A63B 59/00*** | (2006.01) |

(52) U.S. Cl.

CPC ..... *A63B 69/3685* (2013.01); *A63B 53/0466* (2013.01); *A63B 59/0088* (2013.01); *A63B 2053/0408* (2013.01); *A63B 2053/0433* (2013.01); *A63B 2053/0437* (2013.01); *A63B 2053/0441* (2013.01); *A63B 53/0487* (2013.01)

(58) Field of Classification Search

CPC ..... A63B 69/3685; A63B 53/0487; A63B 53/0466; A63B 59/0088; A63B 2053/0408; A63B 2053/0433; A63B 2053/0437; A63B 2053/0441

USPC ..... 473/251–256, 340, 341, 249, 250

See application file for complete search history.

(56) References Cited

U.S. PATENT DOCUMENTS

| | | | | |
|---|---|---|---|---|
| 4,749,196 | A * | 6/1988 | Podgor | 473/250 |
| 7,226,362 | B1 | 6/2007 | Schell et al. | |
| 7,485,047 | B2 * | 2/2009 | Evans | 473/249 |
| 7,601,073 | B2 * | 10/2009 | Henry | 473/249 |
| 7,905,794 | B2 * | 3/2011 | Ross | 473/250 |
| D681,756 | S * | 5/2013 | Wong | D21/744 |
| 2008/0096686 | A1 * | 4/2008 | Bilkhu | 473/340 |
| 2008/0312006 | A1 | 12/2008 | Zielke et al. | |

OTHER PUBLICATIONS

International Search Report of PCT/CA2012/000312 dated Aug. 3, 2012 pp. 1-4.

Written Opinion of PCT/CA2012/000312 dated Aug. 3, 2012 pp. 1-3.

* cited by examiner

*Primary Examiner* — Sebastiano Passaniti

(74) *Attorney, Agent, or Firm* — Smiths IP

(57) ABSTRACT

A golf putter with a clear insert in the clubhead is provided. One or more alignment lines are present on the top and bottom surfaces of the insert and lie directly vertically above one another. The alignment lines assist the player in ensuring that the clubhead is parallel to the ground. If the clubhead is not parallel to the ground, the alignment lines on the top and bottom surfaces will appear offset. The player can then reposition the clubhead until the alignment lines are aligned.

11 Claims, 3 Drawing Sheets

Fig. 3
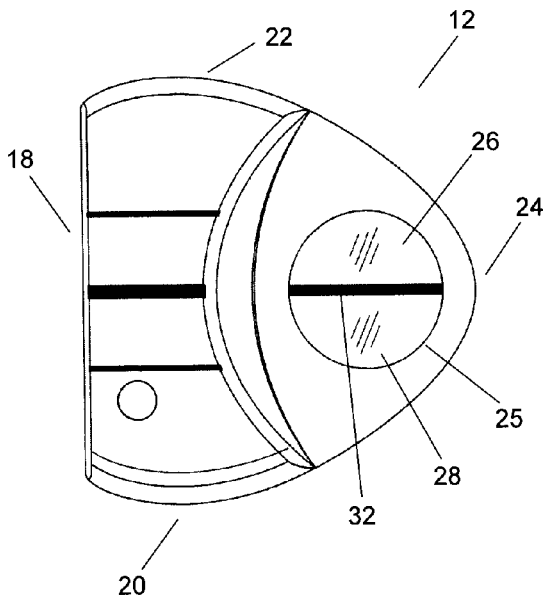
Fig. 4
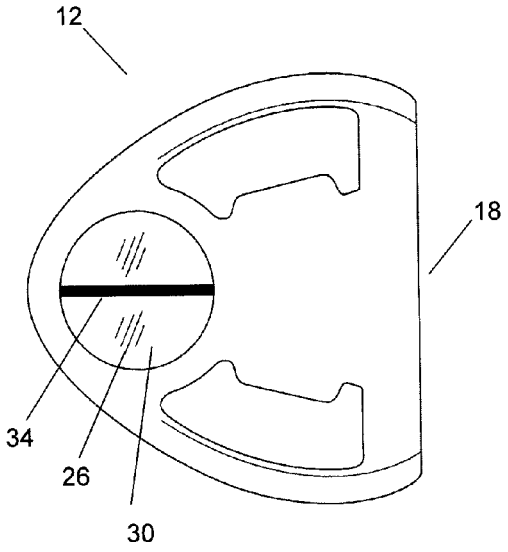
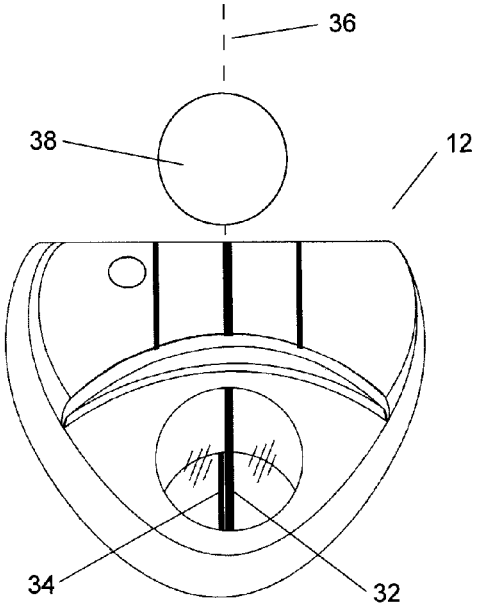
Fig. 5
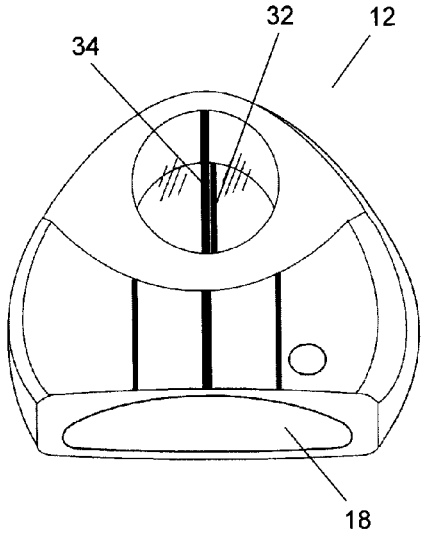
Fig. 6

GOLF PUTTER WITH CLEAR ALIGNMENT AID INSERT

CROSS-REFERENCE TO RELATED APPLICATIONS

This application is a national phase entry under 35 U.S.C. §371 of International Application No. PCT/CA2012/000312 filed Mar. 26, 2012, which claims the benefit of U.S. Provisional Application No. 61/470,272, filed Mar. 31, 2011. The entire contents of the abovementioned provisional patent application are hereby incorporated by reference.

FIELD OF THE INVENTION

The invention relates to putters for playing golf. In particular, the invention relates to a clubhead for a putter.

BACKGROUND OF THE INVENTION

A putter is a type of club used in playing golf. It typically comprises a grip to allow the club to be held by the player, a clubhead for impacting a golf ball, and a shaft connecting the grip and the clubhead. The clubhead comprises a clubface, which is typically a substantially flat surface that comes into contact with the golf ball. It is usually desirable that the clubface impact the golf ball squarely, so that the golf ball travels relatively straight. In order for the clubface to impact the golf ball squarely, it is desirable that, at the time of impact, the clubface is substantially perpendicular to the ground and that the clubface is substantially perpendicular to the intended path of the golf ball (also known as the target line).

It is often difficult for a player to gauge the orientation of the clubhead with respect to the target line and the ground. Therefore, there is a need for a putter that assists the player with hitting the golf ball squarely.

SUMMARY OF THE INVENTION

The present invention provides a putter with a clear insert that spans the entire height of the clubhead. One or more alignment lines are etched or printed on the top and bottom surfaces of the insert, with the lines on the top surface being directly above the lines on the bottom surface. When the putter is held such that the bottom of the clubhead is parallel to the ground, the top lines, when viewed from above, will align with the bottom lines. This indicates to the player that the bottom of the clubhead is parallel to the ground. Conversely, if the player sees an offset between the top lines and the bottom lines, then the player is able to determine that the bottom of the clubhead is not parallel to the ground and can make the necessary adjustments to correct the positioning of the putter.

In one aspect of the invention, a putter comprises a shaft, a grip attached to the shaft, and a clubhead attached to the shaft. The clubhead comprises a substantially flat clubface at one end of the clubhead, an aperture extending an entire height of the clubhead, and an insert fitted within the aperture. The insert comprises a top surface and a bottom surface, with the top surface comprising one or more top alignment lines and the bottom surface comprising one or more corresponding bottom alignment lines. Each of the top alignment lines is directly vertically above the corresponding one of the bottom alignment lines.

In another aspect of the invention, the top surface and the bottom surface of the insert are circular.

In yet another aspect of the invention, the top and bottom alignment lines are printed on the insert.

In a further aspect of the invention, the top and bottom alignment lines are etched on the insert.

In an aspect of the invention, the top and bottom alignment lines are of different colours.

In another aspect of the invention, the top and bottom alignment lines are oriented perpendicular to the clubface.

In a further aspect of the invention, the top and bottom alignment lines are oriented parallel to the clubface.

In yet a further aspect of the invention, some of the top and bottom alignment lines are oriented perpendicular to the clubface and others of the top and bottom alignment lines are oriented parallel to the clubface.

In an aspect of the invention, the insert is removable.

In another aspect of the invention, the insert is made of plastic.

In a further aspect of the invention, the top and bottom surfaces of the insert have diameters approximate to that of a golf ball.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The invention will be described by reference to the detailed description of the preferred embodiment and to the drawings thereof in which:

FIG. 3 is a top view of the clubhead of the putter;

FIG. 4 is a bottom view of the clubhead of the putter;

FIG. 5 is a view of the clubhead of the putter with the alignment lines offset;

FIG. 6 is another view of the clubhead of the putter with the alignment lines offset;

DETAILED DESCRIPTION OF THE PREFERRED EMBODIMENT

Figure 1:
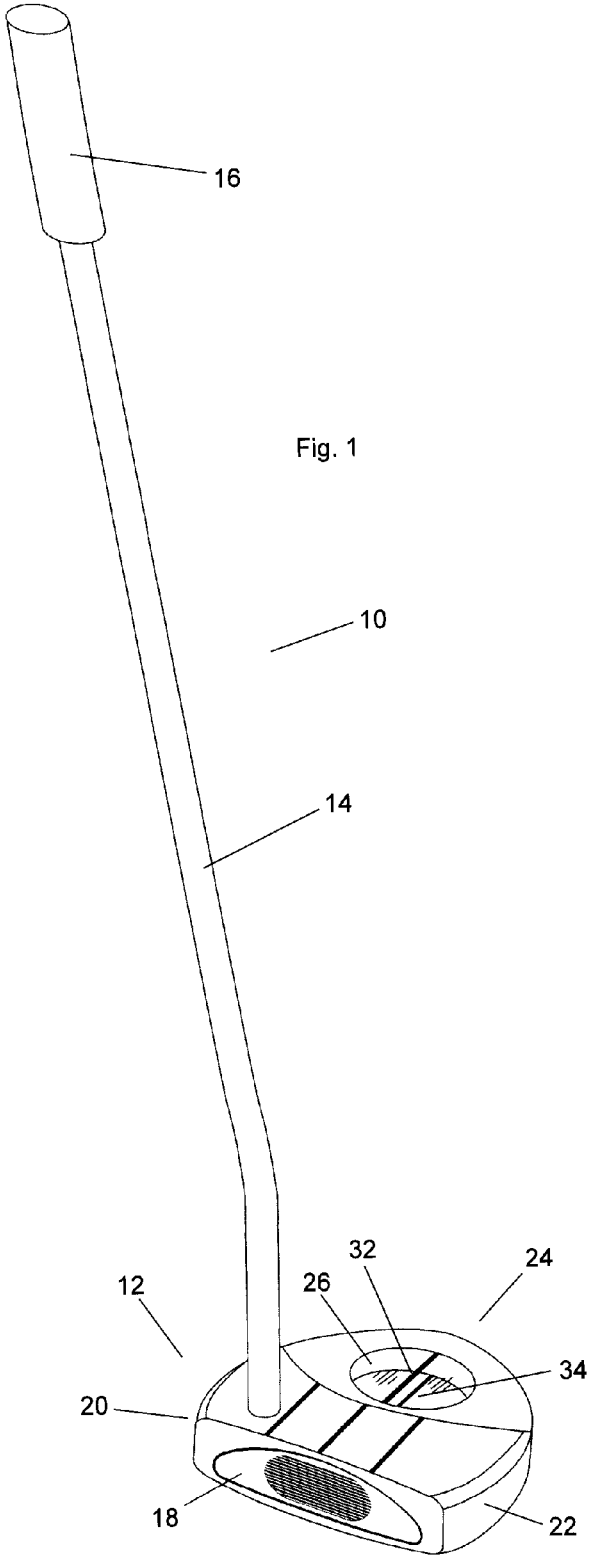
FIG. 1 is a front perspective view of the putter according to the preferred embodiment of the invention.
Figure 2:
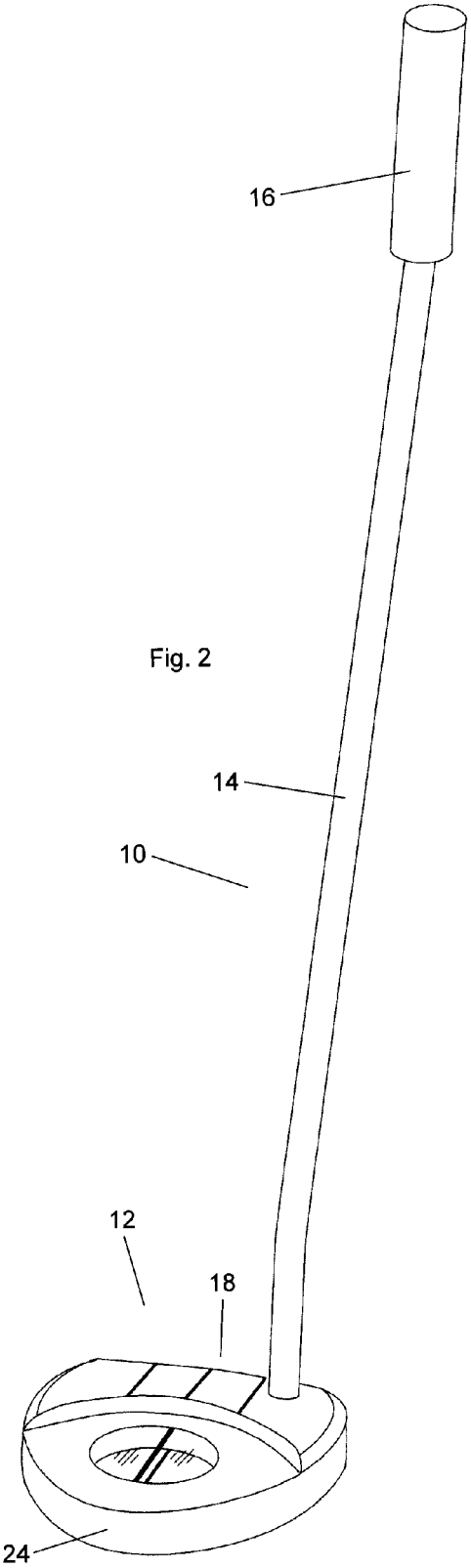
FIG. 2 is a rear perspective view of the putter.

Referring to FIGS. 1 to 6, a golf putter 10 of the present invention comprises a shaft 14, a clubhead 12 attached to one end of the shaft 14, and a grip 16 attached to the other end of the shaft 14. The clubhead 12 comprises a substantially flat clubface 18 for impacting a golf ball 38, a near side 20 (the side closest to the player when the putter 10 is held in position), a far side 22 (the side farthest from the player when the putter 10 is held in position), and an opposing side 24 (the side opposite from the clubface 18). In the embodiment shown in FIGS. 1 and 2, the near side 20, the far side 22, and the opposing side 24 form a smooth surface. However, other shapes and configuration of the clubhead 12 are also possible.

The clubhead 12 further comprises an aperture 25, within which a substantially clear insert 26 is fitted. The aperture 25 extends the entire height of the clubhead 12. The insert 26 comprises a top surface 28 and a bottom surface 30. In one embodiment, the insert 26 is made of a clear plastic material and shaped such that the top and bottom surfaces 28, 30 are flush with the top and bottom, respectively, of the clubhead 12. In FIGS. 1 to 6, the aperture 25 and the insert 26 are substantially cylindrically shaped, with both the top and bottom surfaces 28, 30 of the insert 26 being substantially circular. In one embodiment, the diameter of the top and bottom surfaces, 28, 30 approximate the diameter of a standard golf ball 38; however, other shapes or sizes for the insert 26 are also possible. Furthermore, in another embodiment, the insert 26 may be made detachable from the aperture 25.

Figure 7:
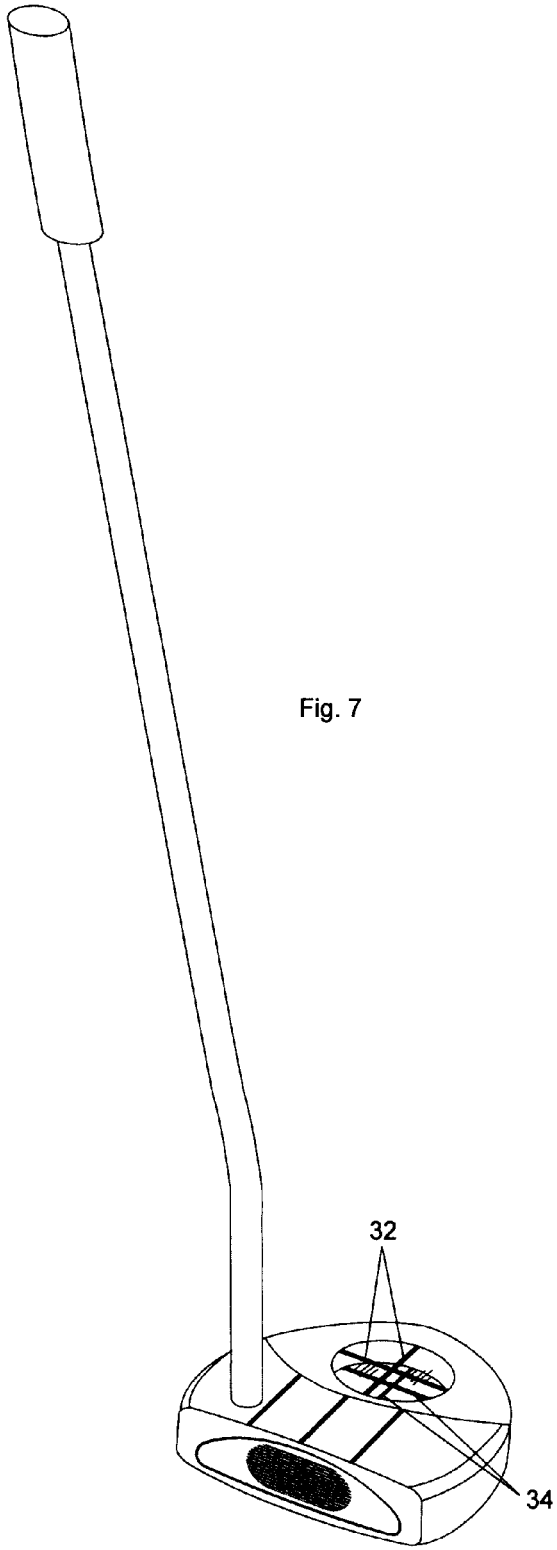
FIG. 7 is a front perspective view of a putter with an alternative arrangement of the top and bottom alignment lines.
Figure 8:
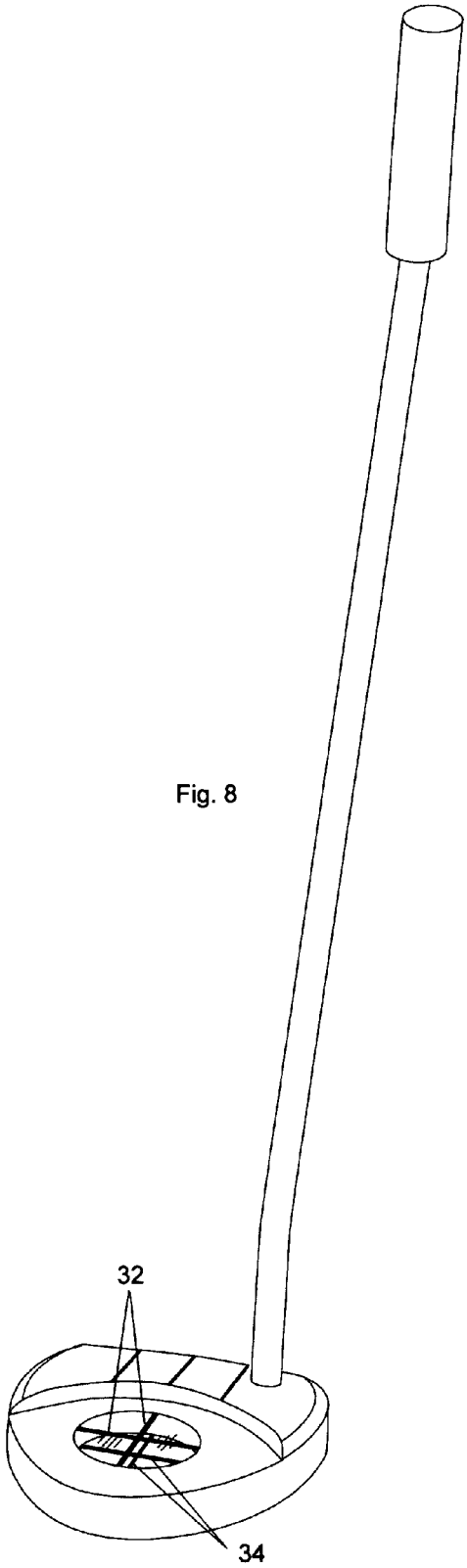
FIG. 8 is a rear perspective view of the putter of FIG. 7.

The top surface 28 of the insert 26 comprises one or more top alignment lines 32, while the bottom surface 30 of the insert 26 comprises one or more corresponding bottom alignment lines 34. In FIGS. 1 to 6, one top alignment line 32 and one bottom alignment line 34 are shown; however, additional alignment lines 32, 34 may be present. In the case of the putter 10 of FIGS. 1 to 6, the top and bottom alignment lines 32, 34 span the diameter of the top and bottom surfaces 28, 30, respectively, and are oriented in a perpendicular direction to the surface of the clubface 18. Additional alignment lines 32, 34, such as those that are oriented in a parallel direction to the surface of the clubface 18 may also be used, such as shown in the embodiments depicted in FIGS. 7 and 8. In FIGS. 7 and 8, the top alignment lines 32 are arranged in a cross, with one line oriented in a perpendicular direction to the surface of the clubface 18 and one line oriented in a parallel direction to the surface of the clubface 18. Similarly, the bottom alignment lines 34 are also arranged in a cross, with one line oriented in a perpendicular direction to the surface of the clubface 18 and one line oriented in a parallel direction to the surface of the clubface 18.

As best shown in FIGS. 3 and 4, the top alignment line 32 lies directly vertically above the bottom alignment line 34, with both lines preferably running parallel to the intended path of the golf ball 38 (i.e. target line 36).

The top and bottom alignment lines 32, 34 may be etched or printed on the top and bottom surfaces 28, 30, respectively, of the insert 26. In one embodiment, the top and bottom alignment lines 32, 34 may be of different colours in order to ease the player in differentiating between the top and bottom alignment lines 32, 34. For example, the top alignment line 32 may be green-coloured, while the bottom alignment line 34 may be red-coloured. Different combinations of colours for the top and bottom alignment lines 32, 34 are also possible.

When a player is preparing to hit the golf ball 38, the player will typically place the putter 10 behind the golf ball 38 in a manner such that the clubhead 12 is substantially parallel (i.e. flat) to the ground. If the bottom of the clubhead 12 is not parallel to the ground (e.g. the far side 22 of the clubhead 12 is higher off the ground than the near side 20 of the clubhead 12), this may result in the clubface 18 not impacting the golf ball 38 squarely during the golf stroke.

If the clubhead 12 is not substantially parallel to the ground, the player will be able to identify this situation by viewing the alignment lines 32, 34. In a typical putting stance, the player stands over the clubhead 12 and the golf ball 38. As a result, the player is able to look through the insert 26. Since the top alignment line 32 on the top surface 28 of the insert 26 are directly above the corresponding bottom alignment line 34 on the bottom surface 30 of the insert 26, if the clubhead 12 is not completely parallel to the ground, when the player looks through the insert 26 from above, the top alignment line 32 will appear offset from the bottom alignment line 34 on the bottom surface 30 (as shown in FIGS. 5 and 6). Since the insert 26 is clear, the player will be able to observe this offset when looking down through the insert 26. The player can then reposition the clubhead 12 until the player sees that the top alignment line 32 is aligned with the bottom alignment line 34 (i.e. the top and bottom alignment lines 32, 34 appear as a single line).

For example, in the putter 10 shown in FIGS. 1 to 6, since the top alignment line 32 and the bottom alignment line 34 both run parallel to the target line 36, the player will be able to detect any instances where the near side 20 of the clubhead 12 may be higher off the ground than the far side 22, or vice versa. If the event of such an occurrence, the player can adjust and reposition the clubhead 12 until the top alignment line 32 is aligned with the bottom alignment line 34 (i.e. when the player is only able to see one line when viewing the insert 26 from above).

As discussed above, it is also possible to have multiple sets of alignment lines 32, 34 run in different orientations on the same insert 26. For example, the top and bottom alignment lines 32, 34 may also run in a direction parallel to the clubface 18 (i.e. perpendicular to the target line 36, as in FIGS. 7 and 8). In such a case, if the end of the clubhead 12 nearer the clubface 18 is higher off the ground than the end of the clubhead 12 nearer the opposing side 24, the player looking down through the insert 26 will observe the top alignment lines 32 slightly offset from the bottom alignment lines 34. The player can then adjust and reposition the clubhead 12 until the top and bottom alignment lines 32, 34 are aligned to form a single visible line, at which point the clubhead 12 should be parallel to the ground, with the clubface 18 perpendicular to the ground. This will result in a hit to the golf ball that is square on. Conversely, if the clubface 18 is opened, the player will tend to "lift" the golf ball; if the clubface 18 is closed, the player will tend to "top" the ball. Neither of these situations will result in a good, accurate putting stroke.

The advantages of the present invention include the following:

(a) promoting the same putting set-up and stance every time;
(b) hitting the golf ball 38 center and at the optimal spot;
(c) minimizing pulling/pushing of the putting stroke;
(d) encouraging the player to keep his or her eyes on top of the golf ball 38 (in order to look down through the insert 26); and
(e) encouraging the player to focus on the golf ball 38 even after the stroke.

In the one embodiment, the clubhead 12 is approximately 1.1 inches high. The clubface 18 is approximately 3.5 inches wide, with the clubhead 12 being approximately 4.0 inches wide at its widest point. The insert 26 is approximately 1.5 inches in diameter and may be approximately 1.5 inches from the clubface 18. The overall length of the clubhead 12 may be approximately 3.75 inches. Other dimensions and shapes for the clubhead 12 are also possible.

It will be appreciated by those skilled in the art that the preferred embodiment has been described in some detail but that certain modifications may be practiced without departing from the principles of the invention.

The invention claimed is:

1. A putter, said putter comprising:
a shaft;
a grip attached to said shaft; and
clubhead attached to said shaft, said clubhead comprising:
a substantially flat clubface at one end of said clubhead;
a top face;
a bottom face;
an aperture extending from said top face to said bottom face; and
a clear insert fitted within said aperture, said insert comprising a top surface flush with said top face and a bottom surface flush with said bottom face, said top surface comprising one or more top alignment lines and said bottom surface comprising one or more corresponding bottom alignment lines, wherein each of said top alignment lines is directly vertically above the corresponding one of said bottom alignment lines and wherein each of said top alignment lines are of the same length and width as the corresponding one of said bottom alignment lines.

2. The putter of claim 1, wherein said top surface and said bottom surface of said insert are circular.

3. The putter of claim 1, wherein said top and bottom alignment lines are printed on said insert.

4. The putter of claim 1, wherein said top and bottom alignment lines are etched on said insert.

5. The putter of claim 1, wherein said top and bottom alignment lines are of different colours.

6. The putter of claim 1, wherein some of said top and bottom alignment lines are oriented perpendicular to said clubface.

7. The putter of claim 1, wherein some of said top and bottom alignment lines are oriented parallel to said clubface.

8. The putter of claim 1, wherein some of said top and bottom alignment lines are oriented perpendicular to said clubface and others of said top and bottom alignment lines are oriented parallel to said clubface.

9. The putter of claim 1, wherein said insert is removable.

10. The putter of claim 1, wherein said insert is made of plastic.

11. The putter of claim 1, wherein said top and bottom surfaces of said insert have diameters approximate to that of a golf ball.

* * * * *